US010753161B2

(12) United States Patent
Silveira et al.

(10) Patent No.: US 10,753,161 B2
(45) Date of Patent: Aug. 25, 2020

(54) DUAL BIT RUN BUSHING SYSTEM AND METHOD

(71) Applicant: Vetco Gray, LLC, Houston, TX (US)

(72) Inventors: Helvecio Carlos Klinke da Silveira, Sao Paulo (BR); Carlos Alexandre Marinho Lolo Vieira, Sao Paulo (BR); Guaraci Bornia, Sao Paulo (BR); Deivis Alves Verdan, Sao Paulo (BR)

(73) Assignee: VETCO GRAY, LLC, Houston, TX (US)

( * ) Notice: Subject to any disclaimer, the term of this patent is extended or adjusted under 35 U.S.C. 154(b) by 252 days.

(21) Appl. No.: 15/903,375

(22) Filed: Feb. 23, 2018

(65) Prior Publication Data

US 2018/0238121 A1 Aug. 23, 2018

Related U.S. Application Data

(60) Provisional application No. 62/462,620, filed on Feb. 23, 2017.

(51) Int. Cl.

| | |
|---|---|
| ***E21B 17/10*** | (2006.01) |
| ***E21B 33/03*** | (2006.01) |
| ***E21B 17/12*** | (2006.01) |
| ***E21B 33/04*** | (2006.01) |
| ***E21B 34/02*** | (2006.01) |

(52) U.S. Cl.

CPC ..... *E21B 17/1007* (2013.01); *E21B 17/12* (2013.01); *E21B 33/04* (2013.01); *E21B 34/02* (2013.01)

(58) Field of Classification Search

CPC ..... E21B 17/12; E21B 17/1007

See application file for complete search history.

(56) References Cited

U.S. PATENT DOCUMENTS

| | | | |
|---|---|---|---|
| 5,044,438 | A | 9/1991 | Young |
| 5,533,574 | A | 7/1996 | Gonzalez |
| 6,719,044 | B2 | 4/2004 | Ford et al. |
| 6,945,325 | B2 | 9/2005 | Ford et al. |
| 7,284,616 | B2 | 10/2007 | Williams et al. |

(Continued)

FOREIGN PATENT DOCUMENTS

| | | |
|---|---|---|
| WO | 2012/096581 | 7/2012 |

OTHER PUBLICATIONS

International Search Report dated Jun. 4, 2018 in corresponding PCT Application No. PCT/US2018/019384.

(Continued)

*Primary Examiner* — Robert E Fuller

(74) *Attorney, Agent, or Firm* — Hogan Lovells US LLP

(57) ABSTRACT

A system includes a housing section positioned within a wellhead area, the housing section also includes a removable wellhead bushing arranged over at least one engagement feature of the housing. The system also includes a Christmas tree including a treehead area, the treehead area includes a removable treehead bushing arranged over at least one engagement feature of the treehead area. The system further includes a tubular extending through both the wellhead bushing and the treehead bushing, wherein the tubular includes an installation and removal tool adapted to remove at least one of the wellhead bushing and the treehead bushing during wellbore operations.

19 Claims, 13 Drawing Sheets

(56) References Cited

U.S. PATENT DOCUMENTS

| | | | | |
|---|---|---|---|---|
| 7,647,973 | B2 * | 1/2010 | Minassian | E21B 17/1007 166/338 |
| 2003/0019632 | A1 | 1/2003 | Humphrey | |
| 2003/0051878 | A1 * | 3/2003 | DeBerry | E21B 7/12 166/348 |
| 2005/0103503 | A1 | 5/2005 | Williams | |
| 2011/0108275 | A1 * | 5/2011 | Borak | E21B 17/1007 166/308.1 |
| 2013/0213661 | A1 | 8/2013 | Reimert | |
| 2016/0047183 | A1 | 2/2016 | Jekot | |

OTHER PUBLICATIONS

International Preliminary Report on Patentability dated Sep. 6, 2019 in corresponding PCT Application No. PCT/US2018/019384.

* cited by examiner

DUAL BIT RUN BUSHING SYSTEM AND METHOD

CROSS REFERENCE TO RELATED APPLICATIONS

This application claims priority to U.S. Provisional Patent Application No. 62/462,620 titled "Dual Bit Run Bushing System," filed Feb. 23, 2017, the disclosure of which is incorporated by reference in its entirety.

BACKGROUND OF THE DISCLOSURE

1. Field of the Disclosure

The present disclosure relates in general to formation exploration and recovery systems, and more particularly to bore protection systems.

2. Brief Description of Related Art

During downhole exploration operations, such as oil and gas drilling, various components may include one or more shoulders or surfaces that interact with associate components. For example, a tubing hanger may include a shoulder or ledge that mates with an associated shoulder on tubing to facilitate downhole recovery operations. In certain instances, these shoulders may be pressure-containing or otherwise configured to support a large amount of force from the associated equipment, and as a result, a tight fit between the components is desirable to facilitate successful downhole operations. However, often various runs of equipment may be performed through a wellbore, which may damage or otherwise impact the shoulders or other areas within the wellbore. In certain systems, a bushing may be installed along a particular section of the downhole components in order to at least partially protect one or more areas. However, these bushings are often installed and removed with separate trips down the wellbore, which greatly increases the cost and time of the exploration and recovery operations.

SUMMARY OF THE DISCLOSURE

In an embodiment a system for providing protection to one or more wellbore components includes a housing section positioned within a wellhead area, the housing section comprising a removable wellhead bushing arranged over at least one engagement feature of the housing. The system also includes a Christmas tree including a treehead area, the treehead area comprising a removable treehead bushing arranged over at least one engagement feature of the treehead area. The system further includes a tubular extending through both the wellhead bushing and the treehead bushing, wherein the tubular includes an installation and removal tool adapted to remove at least one of the wellhead bushing and the treehead bushing during wellbore operations.

In an embodiment a method of installing protection component within a wellbore includes positioning a treehead bushing within a treehead area of a Christmas tree, the treehead bushing extending along a length of the treehead area to cover at least one surface of the treehead area. The method includes positioning a wellhead bushing within a wellhead area of a wellbore, the Christmas tree being fluidly coupled to the wellbore, and the wellhead bushing extending along a length of the wellhead area to cover at least one surface of the wellhead area. The method also includes moving a tubular through the treehead bushing, the tubular comprising an installation and removal tool. The method further includes coupling the installation and removal tool to the wellhead bushing. The method also includes removing the wellhead bushing from the wellbore by passing the wellhead bushing through an inner diameter of the treehead bushing.

In an embodiment a method of installing protection component within a wellbore includes installing a treehead bushing and a wellhead bushing in a wellbore system, the treehead bushing arranged in a treehead area and the wellhead bushing arranged in a wellhead area. The method also includes positioning an installation and removal tool proximate at least one of the treehead bushing and the wellhead bushing, the installation and removal tool being part of a tubular that extends into the wellbore. The method further includes coupling the installation and removal tool to at least one of the treehead bushing and the wellhead bushing. The method also includes removing at least one of the treehead bushing and the wellhead bushing from the wellbore via the installation and removal tool.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE PREFERRED EMBODIMENT

Figure 1:
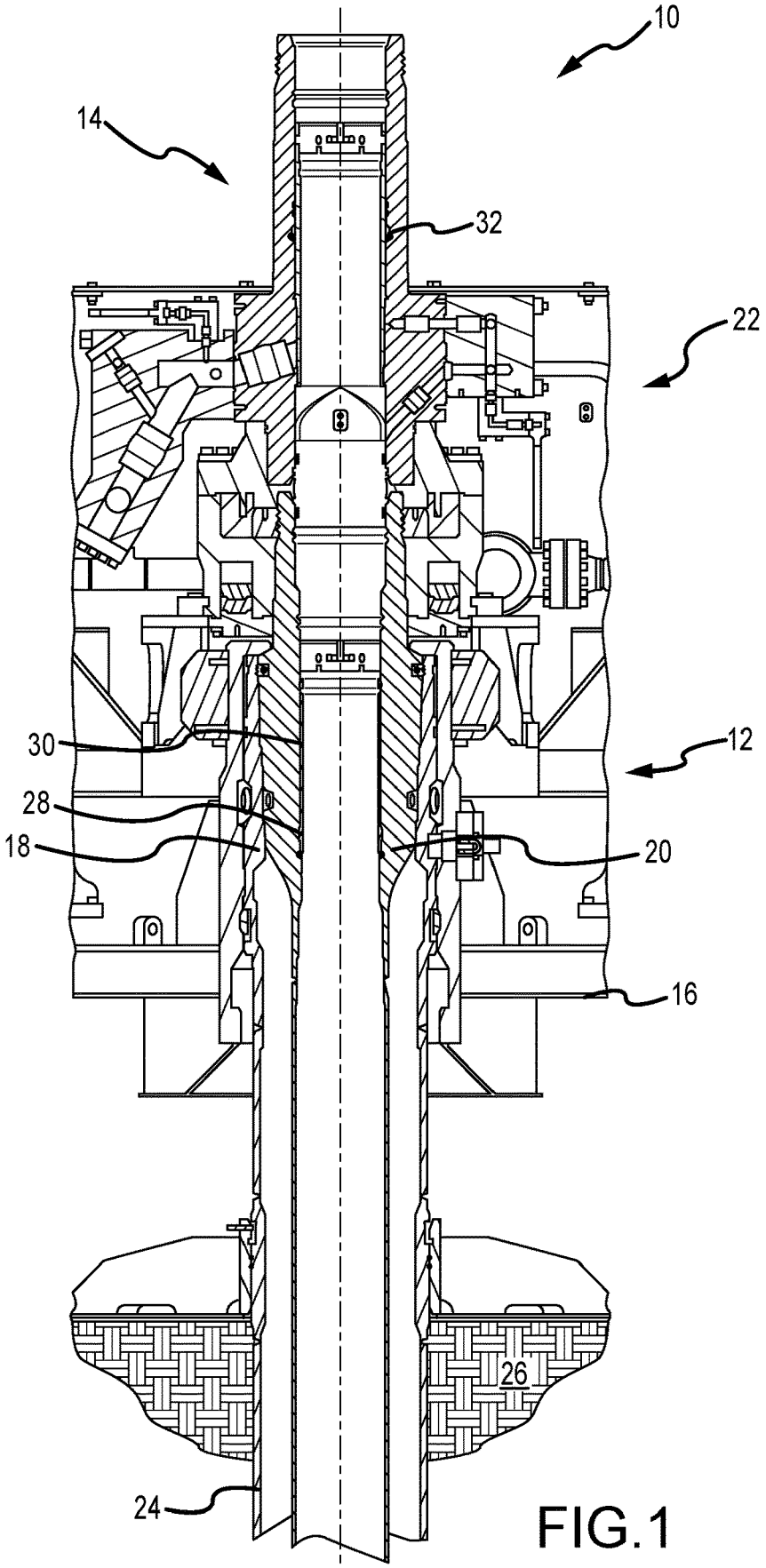
FIG. 1 is a schematic cross-sectional view of an embodiment of a wellbore system with a pair of bushings, in accordance with embodiments of the present disclosure.

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions.

Embodiments of the present disclosure are directed toward systems and methods for facilitate protection of wellbore components. In various embodiments, one or more bushings may be installed at different locations within the wellbore to protect surfaces, such as sealing surfaces or threads, from potential damage due to installation of tools within the wellbore. For example, a treehead bushing may be installed in a treehead area in order to protect portions of a Christmas tree from damage due to trips into and out of the wellbore. Additionally, wellhead bushings may be installed at wellhead areas in order to protect components within the wellhead, such as load bearing shoulders. In various embodiments, an outer diameter of the wellhead bushing is less than an inner diameter of the treehead bushing, thereby enabling installation and removal of the wellhead bushing without removal of the treehead bushing. As a result, a number of runs into the wellbore may be reduced, thereby reducing the costs and time associated with wellbore operations. In various embodiments, a wellbore tubular may be installed within the wellbore that includes one or more installation and removal tools. These tools may be utilized to engage components of the bushings to facilitate installation and removal via axial movement along a wellbore axis. In certain embodiments, the arrangement of the installation and removal tools may be particularly selected to engage both the treehead bushing and the wellbore bushing at approximately the same time (e.g., without changing the axial position of the tubular) or with little delay between engagement. Accordingly, the bushings may be removed at the same time, thereby reducing the number of trips into the wellbore to recover the bushings. It should be appreciated that systems and methods of embodiments disclosed herein may be utilized to remove and/or install one or more bushings while reducing a number of trips into the wellbore.

FIG. 1 is a schematic cross-sectional side elevational view of an embodiment of a wellbore system 10 including a wellhead area 12 and a treehead area 14. In the illustrated embodiment, the wellbore system 10 includes a platform 16 and the wellhead area 12 includes a low pressure housing 18 and a high pressure housing 20. The system 10 further includes a Christmas tree 22 forming at least a portion of the treehead area 14. As illustrated, wellhead area 12 extends into a wellbore 24 formed in a formation 26. It should be appreciated that embodiments of the present disclosure may be utilized in land and sub-sea exploration and production operations.

In various embodiments, the treehead area 14, the wellhead area 12, and the like may include one or more areas that may receive other components associated with the wellbore system 10. For example, shoulders, hangers, notches, threads, grooves, and the like may be arranged along an inner bore to facilitate coupling with other components. In the illustrated embodiment, the wellhead area 12 includes a shoulder 28, which may, in various embodiments, be utilized to receive a casing hanger, a tubing hanger, or the like. Additionally, in the illustrated embodiment, the wellhead area 12 includes wickers 30 arranged uphole of the shoulder 28. As will be appreciated, during wellbore operations, tools may be in installed through the Christmas tree 22 and into the wellbore 24. These tools may include components with hard edges, such as drill bits, which may damage the shoulder 28 and/or the wickers 30. As a result, later operations utilizing these features may be unsuccessful because a sealing surface or the like may be damaged by the tools. Similar features are also illustrated in the treehead area 14, such as notches 32 formed along the bore. As will be described below, systems and methods of the present disclosure are directed toward bushings to protect these components from the tools while also reducing the number of trips to install and remove the bushings.

Figure 2:
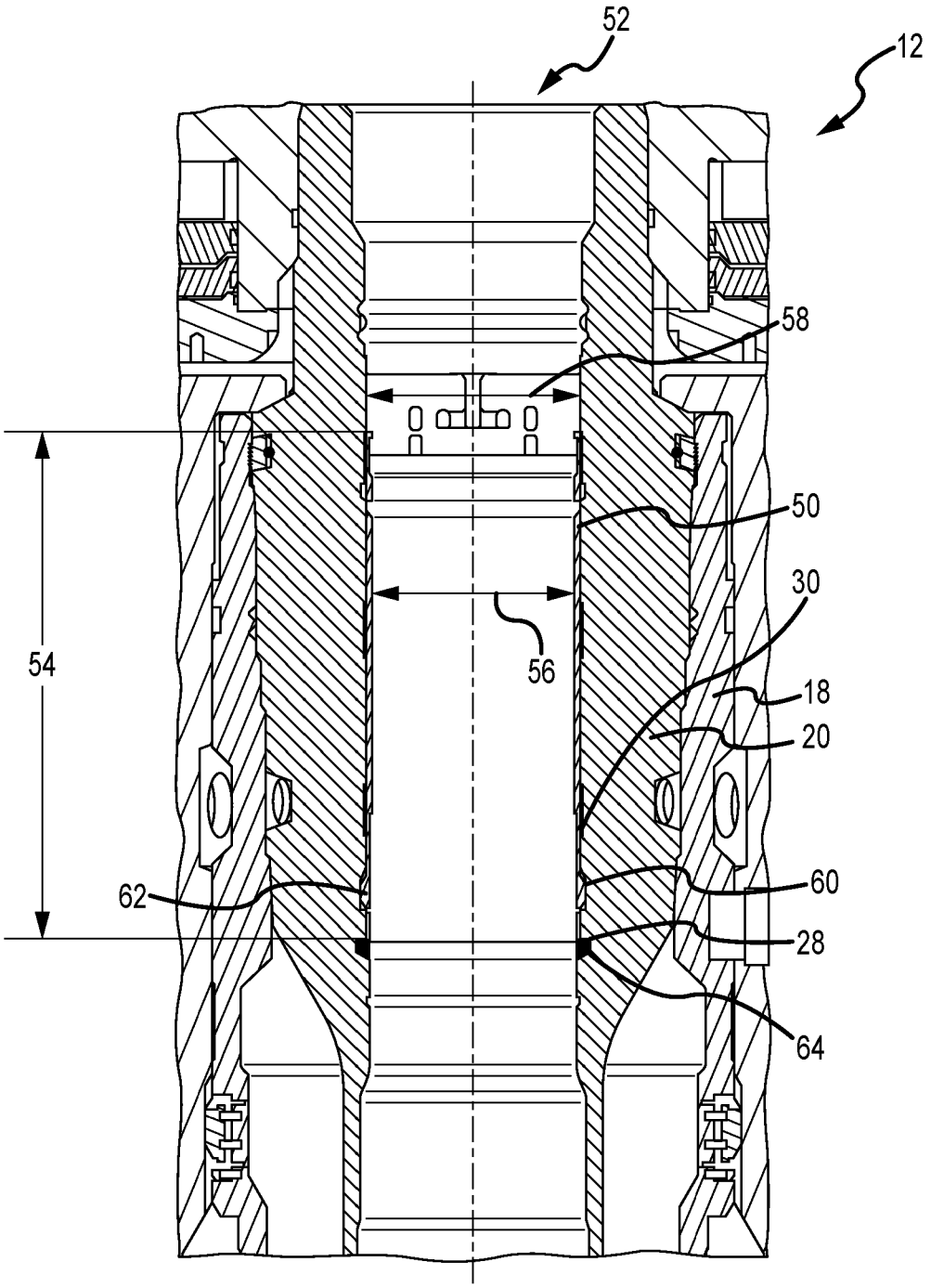
FIG. 2 is a schematic cross-sectional view of an embodiment of a wellhead area, in accordance with embodiments of the present disclosure.

FIG. 2 is a schematic cross-sectional side elevational view of an embodiment of the wellhead area 12 including the low pressure housing 18 and the high pressure housing 20. As described above, the wellhead area 12 includes a plurality of features, such as the shoulder 28 and the wickers 30, which may be utilized to connect or otherwise interact with different components within the system 10. Because these components may provide a sealing or load-bearing surface, the illustrated embodiment includes a wellhead bushing 50 positioned within a bore 52 of the wellhead area 12. The illustrated wellhead bushing 50 extends a length 54, and in the embodiment shown in FIG. 2, covers the shoulder 28 and the wickers 30. However, it should be appreciated that the length 54 of the wellhead bushing 50 may vary based on operational conditions, the size of the wellhead area 12, the size of the bore 52, and the like.

The illustrated embodiment, the wellhead bushing 50 has an inner diameter 56 that is less than an inner diameter 58 of the bore 52. Accordingly, tools and other equipment that extend through the wellhead busing 50 will have a diameter no larger than the wellhead bushing diameter 56. In certain embodiments, the wellhead bushing 50 may include one or more catches to facilitate connection to an installation and recovery tool. For example, the catches may engage and/or disengage via rotation of the installation and recovery tool. Accordingly, the wellhead bushing 50 may be tripped in or tripped out of the wellbore 24 as needed. Furthermore, the wellhead bushing 50 may be replaced in the event it is damaged or otherwise rendered inoperable.

In various embodiments, the wellhead bushing 50 may be positioned at particularly selected locations within the wellhead area 12. For example, the bore 52 may include an annular groove 60 that receives a protrusion 62 that may extend from the wellhead bushing 50. In various embodiments, the protrusion 62 is retracted during installation and removal, but extended into the groove 60 when positioned at the desired location. Furthermore, in the illustrated embodiment, retention features 64 are arranged downhole from the wellhead bushing 50. The retention features 64 may at least partially form the shoulder 28, in the illustrated embodiment, which may be utilized to hold the wellhead bushing 50 in place and block axial movement in at least one direction. Furthermore, the shoulder 28 may provide an indication to an operator when the wellhead bushing 50 has been positioned at the directed location. Accordingly, the wellhead bushing 50 may be arranged within the wellhead area 12 to protect certain components from potential damage during other wellbore operations.

Figure 3:
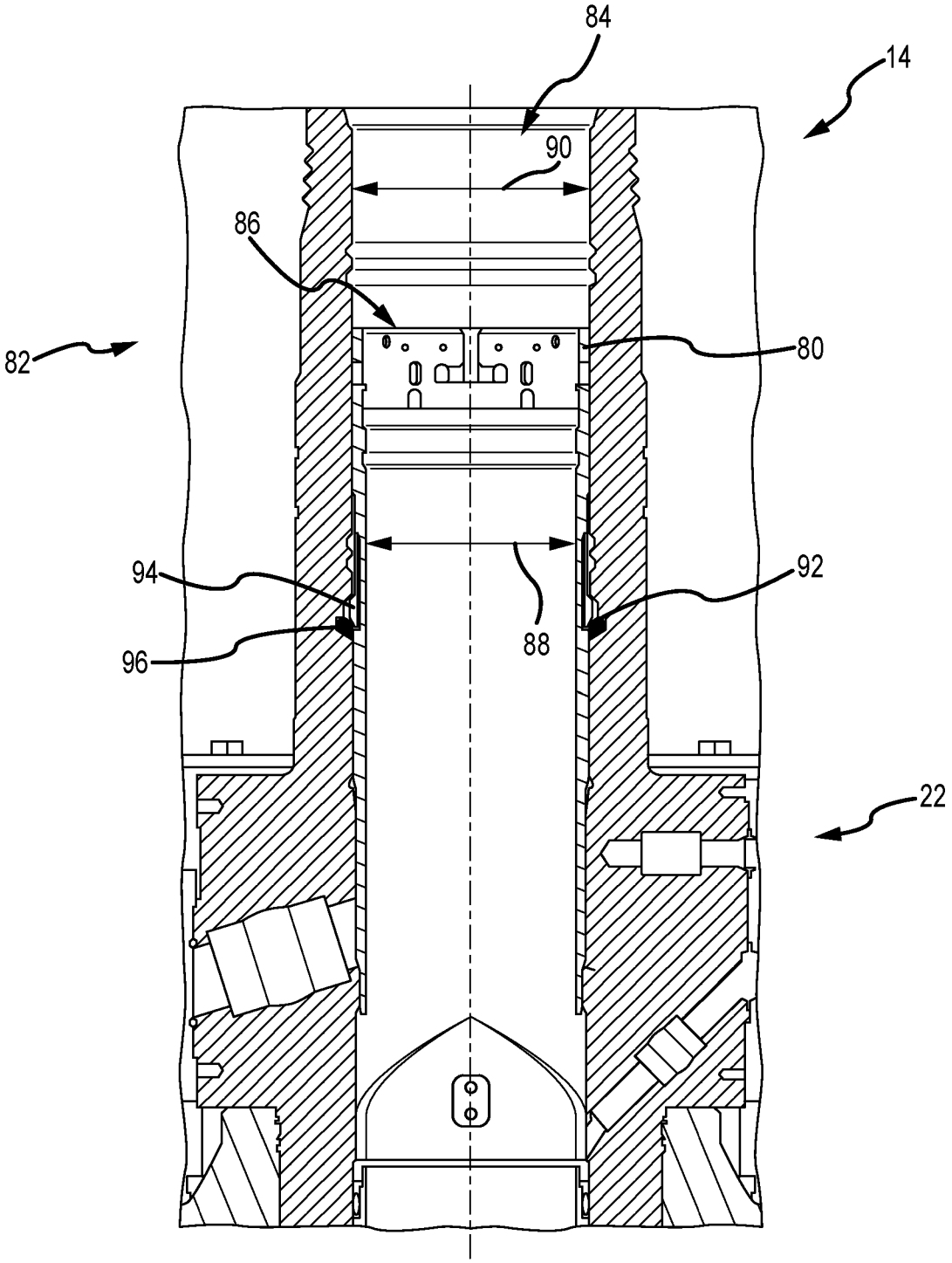
FIG. 3 is a schematic cross-sectional view of an embodiment of a treehead area, in accordance with embodiments of the present disclosure.

FIG. 3 is a schematic side elevational view of an embodiment of the treehead area 14 including a treehead bushing 80. In the illustrated embodiment, the treehead area 14 is toward a top portion 82 of the Christmas tree 22. In certain embodiments, one or more tools may be tripped through the Christmas tree 22, past the treehead area 14, and into the wellbore 24. As a result, the interior surfaces of a treehead bore 84 may be susceptible to damage from the tools as they are tripped into and out of the wellbore 24. The illustrated treehead bushing 80 is arranged within the bore 84 to protect the surfaces and/or features.

In the illustrated embodiment, the treehead bushing 80 includes a bore 86 having an inner diameter 88 that is less than an inner diameter 90 of the bore 84. As a result, the tools extending through the treehead area 14 will have a diameter that is no larger than the treehead bushing bore 86. As described above, in various embodiments the treehead bushing 80 may include a catch or feature to facilitate coupling to an installation and removal tool, for example, via turning of the tool, deployment of dogs, or the like.

In various embodiments, the treehead bushing 80 is landed on a shoulder 92 within the treehead area 14 and/or includes one or more retention features 94 that extend outwardly into a groove 96 formed within the treehead area 14. As a result, the treehead bushing 80 may be installed within the treehead area 14 and lateral movement along a wellbore axis may be limited or otherwise blocked in at least one direction. That is, the treehead bushing 80 may remain substantially in place once installed until the installation and removal tool is utilized to withdraw the treehead bushing 80 from the treehead area 14. Accordingly, the interior bore 86 may be protected during trips through the Christmas tree 22.

Figure 4:
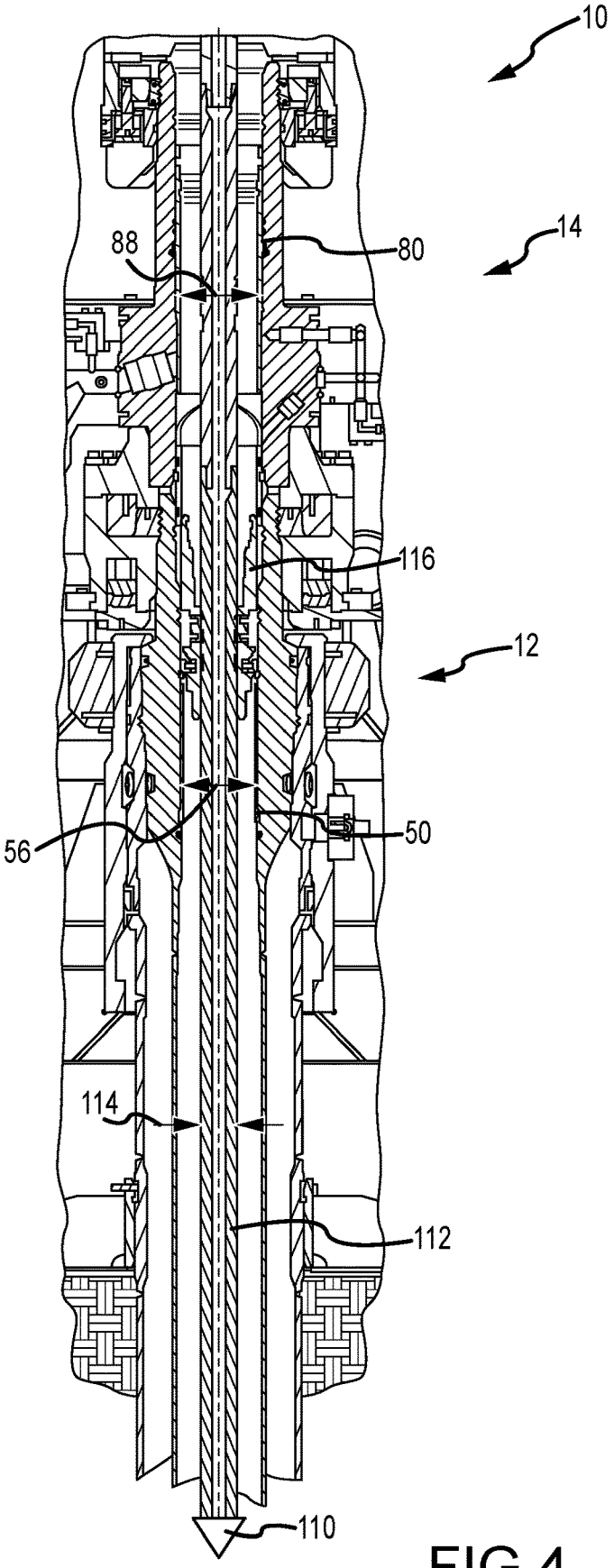
FIG. 4 is a schematic cross-sectional view of an embodiment of a wellbore system, in accordance with embodiments of the present disclosure.

FIG. 4 is a schematic side elevational view of an embodiment of the wellbore system 10 including the wellhead bushing 50 and the treehead bushing 80 installed within the wellhead area 12 and treehead area 14, respectively. As described above, the position of the respective bushings 50, 80 enables tools to be tripped into and out of the wellbore 24 while providing protection to certain interior components. In the illustrated embodiment, a drill bit 110 on a drill string 112 is lowered into the wellbore. The drill bit 110 is through the wellhead bushing 50 and has already passed the treehead bushing 80, in the illustrated embodiment. As shown, an outer diameter 114 of the drill string 112 is less than the diameter 88 of the treehead bushing 80 and less than the diameter 56 of the wellhead bushing 50. Accordingly, the drill string 112 may freely pass into the wellbore 24.

In various embodiments, the drill string 112 further includes an installation and removal tool 116. Accordingly, one or more of the wellhead bushing 50 and/or the treehead bushing 80 may be removed or moved at various times during drilling operations. For example, the wellhead bushing 50 may be removed after drilling operations are completed. By removing or moving the bushings 50, 80 in the same trip that the drill bit 110 is arranged within the wellbore 24, at least one trip into and out of the wellbore 24 may be eliminated, thereby reducing the time and costs associated with performing wellbore operations.

It should be appreciated that, in various embodiments, an outer diameter of the wellhead bushing 50 may be less than the diameter 88 of the treehead bushing 80. Accordingly, the wellhead bushing 50 may be removed through the opening of the treehead bushing 80 without removing the treehead bushing 80. Additionally, in embodiments, the outer diameter of the wellhead bushing 50 may be substantially equal to the inner diameter 88 of the treehead bushing 80 such that removal of the wellhead bushing 50 is accompanied by removal of the treehead bushing 80.

Figure 5:
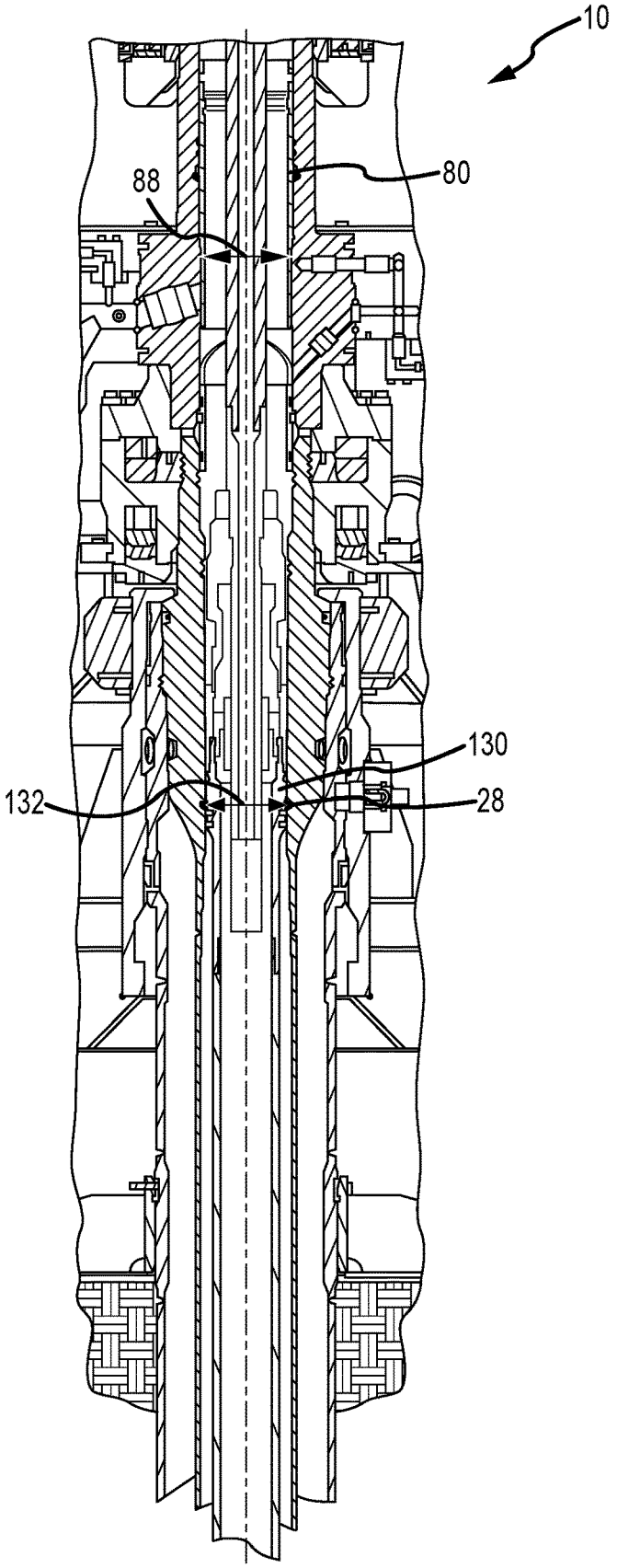
FIG. 5 is a schematic cross-sectional view of an embodiment of a wellbore system including a casing hanger, in accordance with embodiments of the present disclosure.

FIG. 5 is a schematic cross-sectional side elevational view of an embodiment of the wellbore system 10 in which the wellhead bushing 50 is removed while the treehead bushing 80 remains in place in the treehead area 14. As described above, in various embodiments the installation and removal tool 116 may be utilized to remove one or both of the illustrated bushings 50, 80 during different stages of wellbore operations. In the illustrated embodiment, the wellhead bushing 50 may be removed through the treehead bushing 80 due to the difference in diameters, as described above. By keeping the treehead bushing 80 in place, the treehead bore 84 is protected from bumps or scrapes when other equipment is tripped into the wellbore 24, such as the illustrated casing hanger 130. In the illustrated embodiment, the casing hanger 130 has an outer diameter 132 that is less than the diameter 88 of the treehead bushing 80, thereby facilitating passage into the wellbore 24. As shown, the casing hanger 130 is positioned proximate the high pressure housing 20, near the location where the wellhead bushing 50 had previously protected the features associated with the high pressure housing 20. Accordingly, the shoulder 28 that had previously positioned the wellhead bushing 50 in place may now be utilized to retain the casing hanger 130. Advantageously, the wellhead bushing 50 may have protected the shoulder 28 from damage during other operations, thereby maintaining the integrity of the seal between the casing hanger 130 and the shoulder 28.

Figure 6:
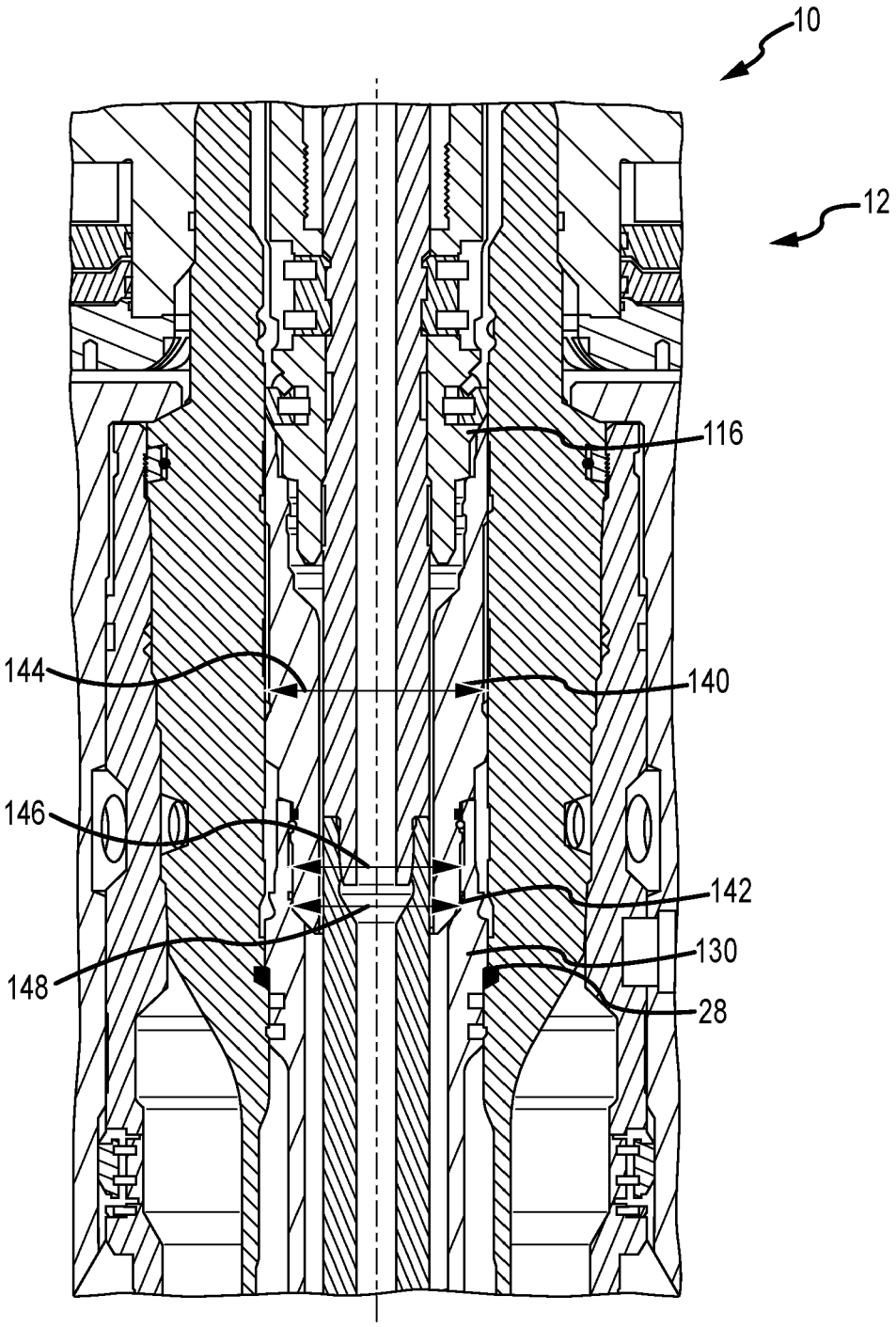
FIG. 6 is a schematic cross-sectional view of an embodiment of a wellhead area including a casing system and wellhead wear bushing, in accordance with embodiments of the present disclosure.

FIG. 6 is a schematic cross-sectional side elevational view of an embodiment of the wellbore system 10 in which a wellhead wear bushing 140 is installed proximate the casing hanger 130 in order to protect one or more shoulders 142 of the casing hanger 130. In various embodiments, the bushings described herein may be utilized to protect additional components installed within the wellbore 24, such as the illustrated casing hanger 130. In the illustrated embodiment, the wellhead wear bushing 140 extends at least partially into the bore of the casing hanger 130 and also along the wellhead bore 52. As such, multiple components may be protected, via isolation, from running tools extending through the wellbore 24.

In various embodiments, the installation and removal tool 116 is tripped into the wellbore 24 with the wellhead wear bushing 140. The illustrated wellhead wear bushing 140 has an outer diameter 144 less than the diameter 88 of the treehead bushing 80, thereby enabling installation without removal of the treehead bushing 80. In operation, the wellhead wear bushing 140 is coupled to the installation and removal tool 116 (e.g., via dogs that engage receptacles on an interior portion of the bushing 140) and lowered into the wellbore 24. Upon reaching the casing hanger 130, the installation and removal tool 116 disengages from the wellhead wear bushing 140. In various embodiments, the wellhead wear bushing 140 rests on the shoulder 142, thereby limiting axial movement of the wellhead wear bushing 140 in at least one direction. Accordingly, downhole operations may commence, such as drilling, while the casing hanger 130 is in position and protected from potential damage due to tripping tools in and out of the wellbore 24. In the illustrated embodiment, the wellhead wear bushing second outer diameter 146 is less than at least a first inner diameter 148 of the casing hanger 130. Accordingly, the likelihood of downhole tools slipping or being angled toward the casing hanger 130 is reduced, which further protects the casing hanger 130.

Figure 7:
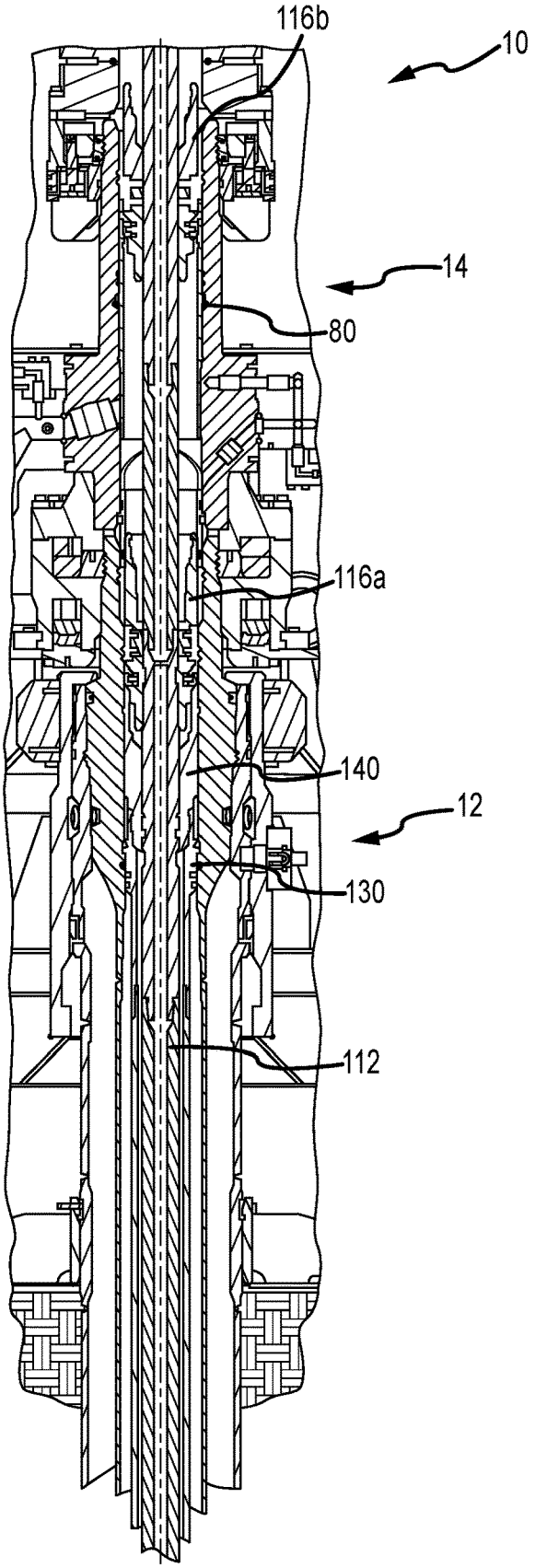
FIG. 7 is a schematic cross-sectional view of an embodiment of a wellbore system, in accordance with embodiments of the present disclosure.

FIG. 7 is a schematic cross-sectional side elevational view of an embodiment of the wellbore system 10 in which the treehead bushing 80 and the wellhead wear bushing 140 are each engaged with an independent installation and removal tool 116*a*, 116*b* to facilitate removal from the wellbore 24. In various embodiments, the location of the installation and removal tools 116*a*, 116*b* may be particularly selected along the drill string 112 in order to remove the bushings 80, 140 in a predetermined order. Further, in embodiments, the location may be particularly selected to remove the bushings 80, 140 at approximately the same time. For example, the bushings 80, 140 may be engaged via dogs of the installation and removal tools 116*a*, 116*b* that are deployed with rotation of the drill string 112. Accordingly, aligning the tools 116*a*, 116*b* to deploy the dogs approximately simultaneously may simplify removal of the respective bushings 80, 140.

Figure 8A:
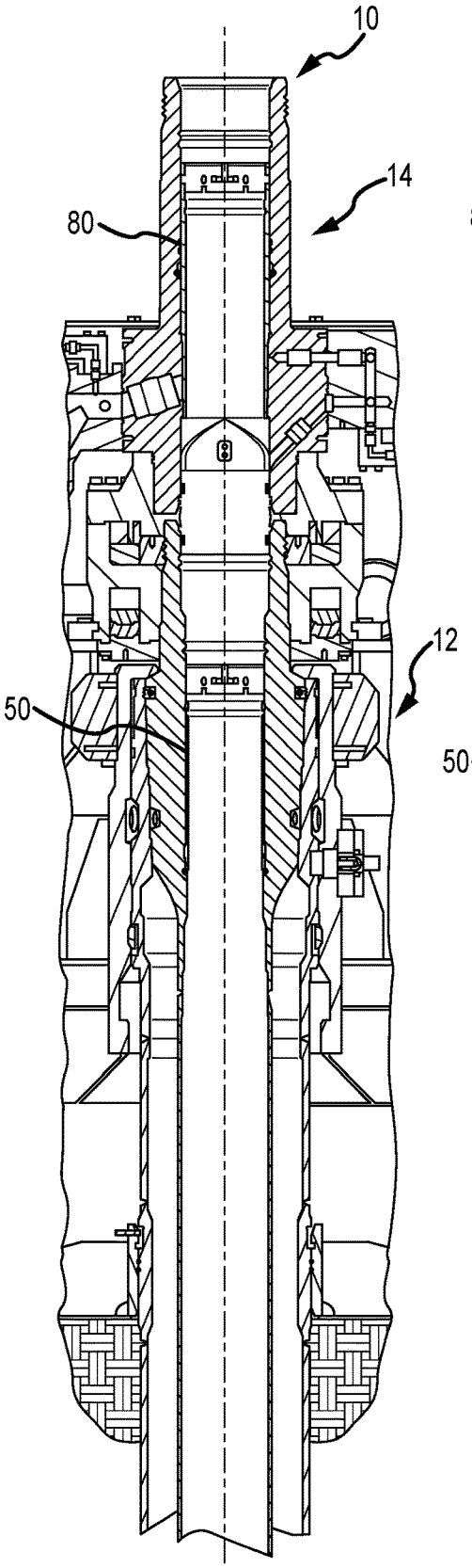
FIG. 8A is a schematic cross-sectional view of an embodiment of a wellbore system, in accordance with embodiments of the present disclosure.
Figure 8B:
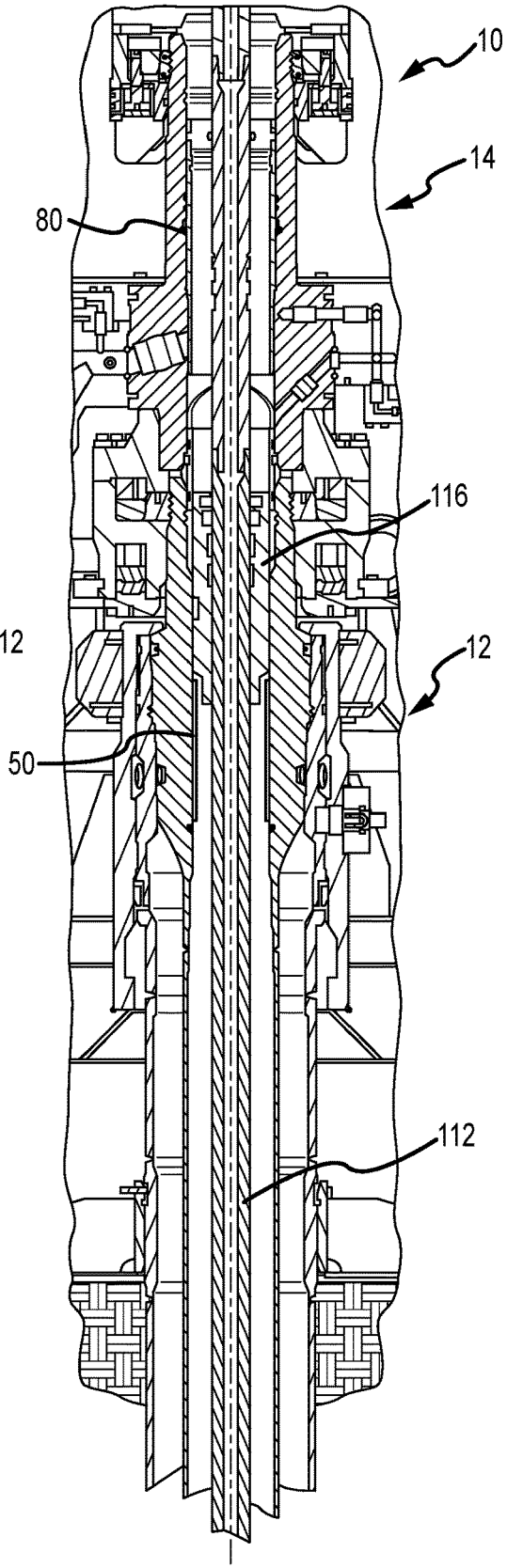
FIG. 8B is a schematic cross-sectional view of an embodiment of a wellbore system, in accordance with embodiments of the present disclosure.
Figure 8C:
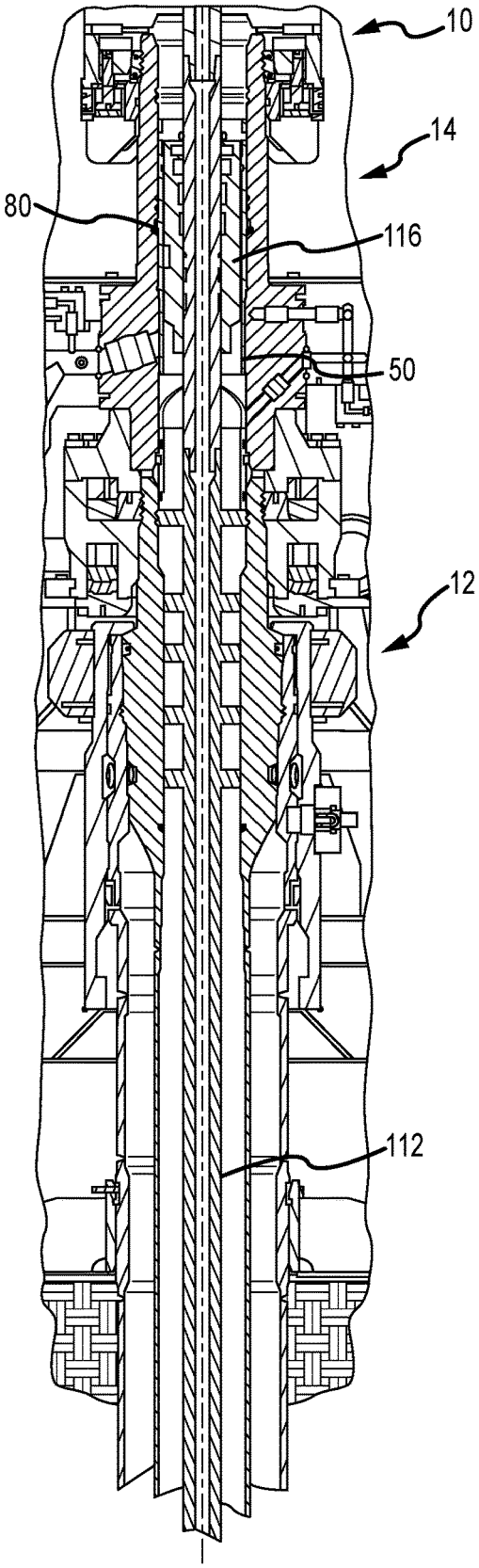
FIG. 8C is a schematic cross-sectional view of an embodiment of a wellbore system, in accordance with embodiments of the present disclosure.
Figure 8D:
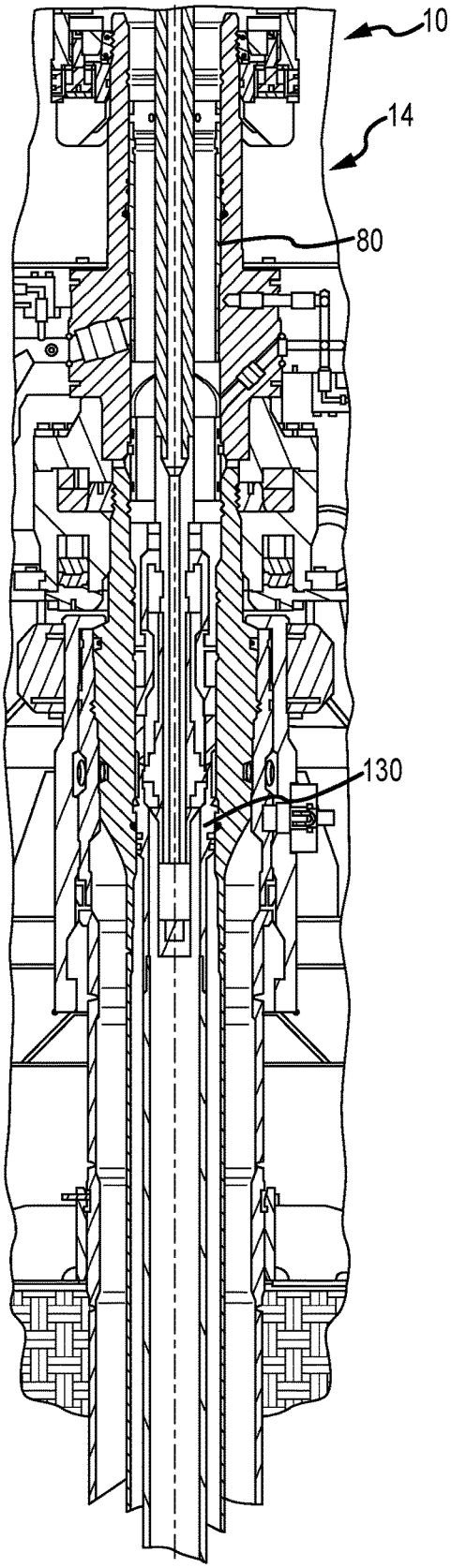
FIG. 8D is a schematic cross-sectional view of an embodiment of a wellbore system, in accordance with embodiments of the present disclosure.

FIGS. 8A-8G illustrate a sequence for installing and removing various bushings 50, 80, and 140 from the wellbore 24. FIG. 8A illustrates the wellbore system 10 including both the wellhead bushing 50 and the treehead bushing 80. In various embodiments, one or more of the wellhead bushing 50 and the treehead bushing 80 may be pre-installed before interaction with the wellbore 24. That is, as the high pressure housing 20 is tripped into the wellbore 24, there may also be the wellhead bushing 50 installed. Accordingly, at least one trip into the wellbore 24 may be saved, thereby reducing cost and time associated with drilling operations. FIG. 8B illustrates a wellbore operation, such as a drilling operation via the drill string 112 and the drill bit 110 commencing through the wellbore 24. As illustrated, the bushings 50, 80 remain in place in order to block potential damage to one or more surfaces due to the installation of the drill string 112. In the illustrated embodiment, the installation and removal tool 116 is coupled to the drill string 112. FIG. 8C illustrates the drill string 112 being removed from the wellbore 24 and removing the wellhead bushing 50 as the drill bit 110 is removed from the wellbore 24. In various embodiments the installation and removal tool 116 engages the wellhead bushing 50 such that the wellhead bushing 50 is moved axially within the wellbore 24 along with the drill string 112. It should be appreciated that, in other embodiments, a different trip into the wellbore 24 may be utilized to remove the wellhead bushing 50. FIG. 8D illustrates installation of additional wellbore components, which in this embodiment is the casing hanger 130. As described above, the casing hanger may be installed through the treehead bushing 80, thereby eliminating the need to remove the treehead bushing 80 before conducting additional downhole operations.

Figure 8E:
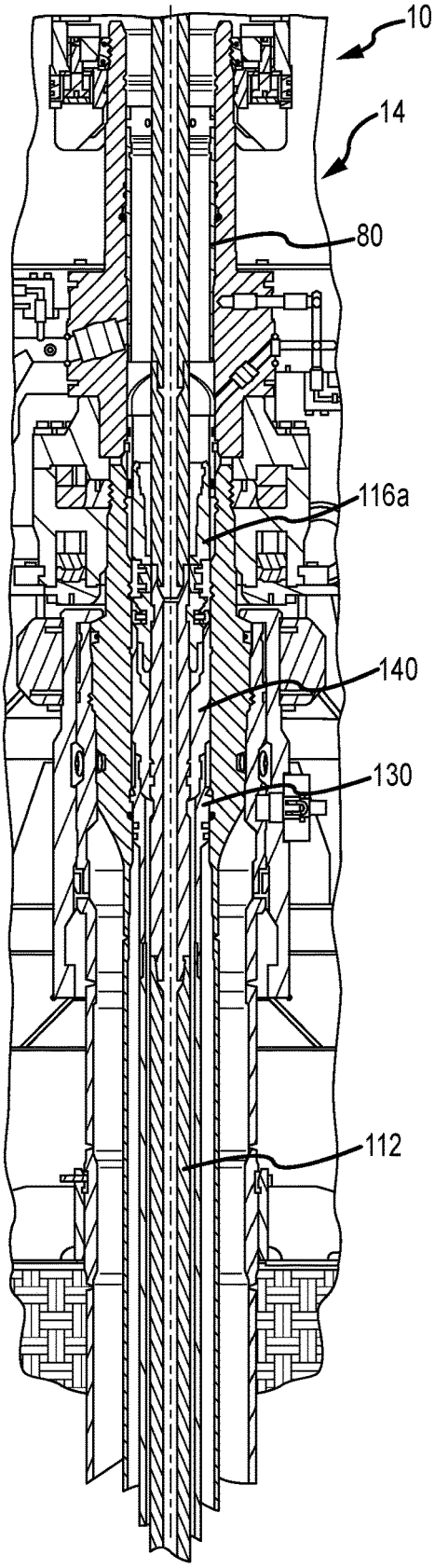
FIG. 8E is a schematic cross-sectional view of an embodiment of a wellbore system, in accordance with embodiments of the present disclosure.
Figure 8F:
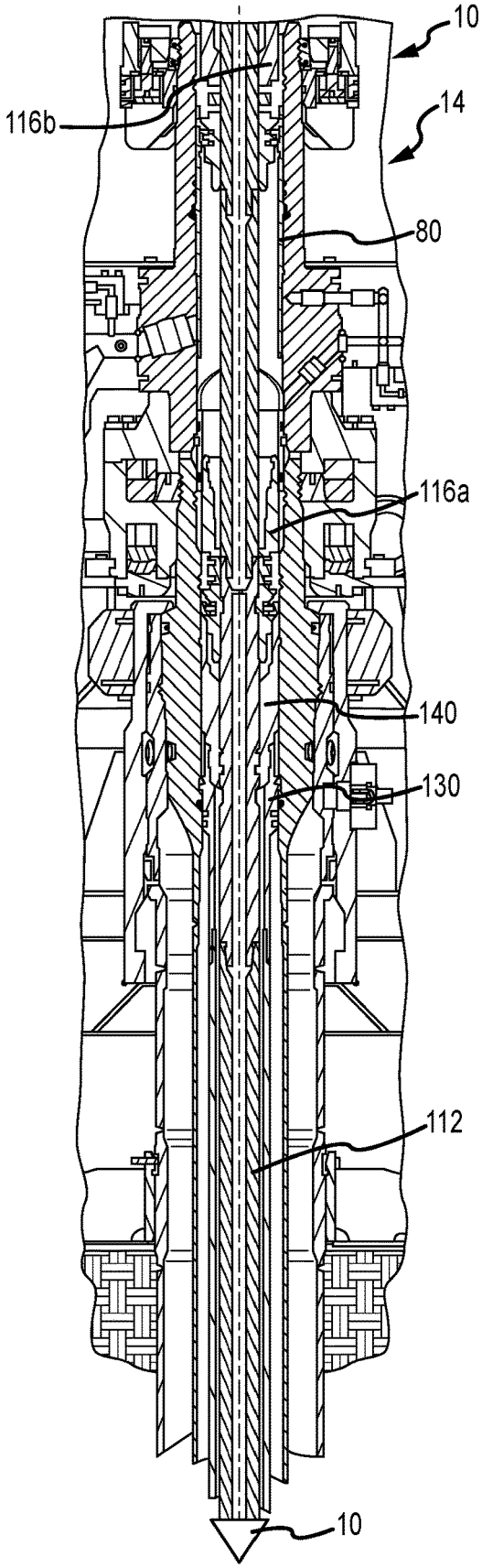
FIG. 8F is a schematic cross-sectional view of an embodiment of a wellbore system, in accordance with embodiments of the present disclosure.
Figure 8G:
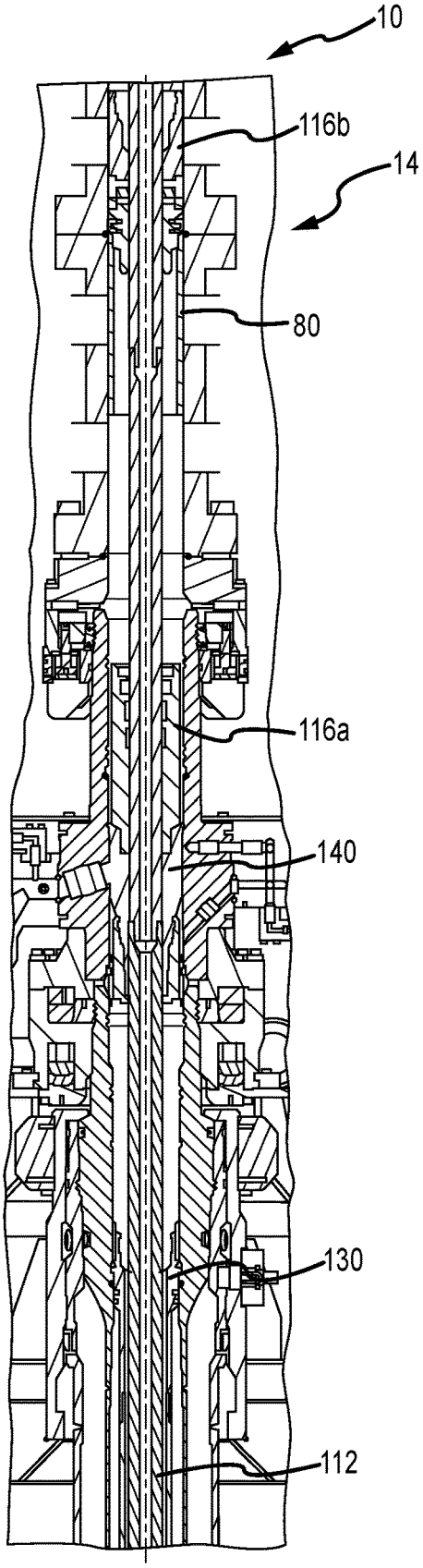
FIG. 8G is a schematic cross-sectional view of an embodiment of a wellbore system, in accordance with embodiments of the present disclosure.

FIG. 8E illustrates installation of the wellhead wear bushing 140 proximate and partially extending into the casing hanger 130. It should be appreciate that, in certain embodiments, the wellhead wear bushing 140 may be installed on the same trip into the wellbore 24 as the casing hanger 130. Additionally, in embodiments, the wellhead wear bushing 140 is installed during a separate trip into the wellbore 24. As described above, the wellhead wear bushing 140 may be installed to at least partially protect surfaces of the casing hanger 130 during tips in and out of the wellbore 24. FIG. 8F illustrates a downhole operation within the wellbore 24, such as a drilling operation as described above. As illustrated, both the treehead bushing 80 and the wellhead wear bushing 140 remain in place as the drill bit 110 is transitioned into the wellbore 24 and performs drilling operations. FIG. 8G illustrates removal of the treehead bushing 80 and the wellhead wear bushing 140. As described above, in certain embodiments the drill string 112 includes a pair of installation and removal tools 116 which enables simultaneous or near-simultaneous removal of the bushings 80, 140. However, it should be appreciated that, in other embodiments, the bushings 80, 140 may be removed in any order and also may be removed individually. Furthermore, the locations of the respective installation and removal tools 116 may be staggered such that one of the bushings 80, 140 is partially removed or unseated while the other remains in place. In this manner, the number of trips into the wellbore 24 may be reduced while maintaining protective coverings over multiple components within the wellbore.

Figure 9:
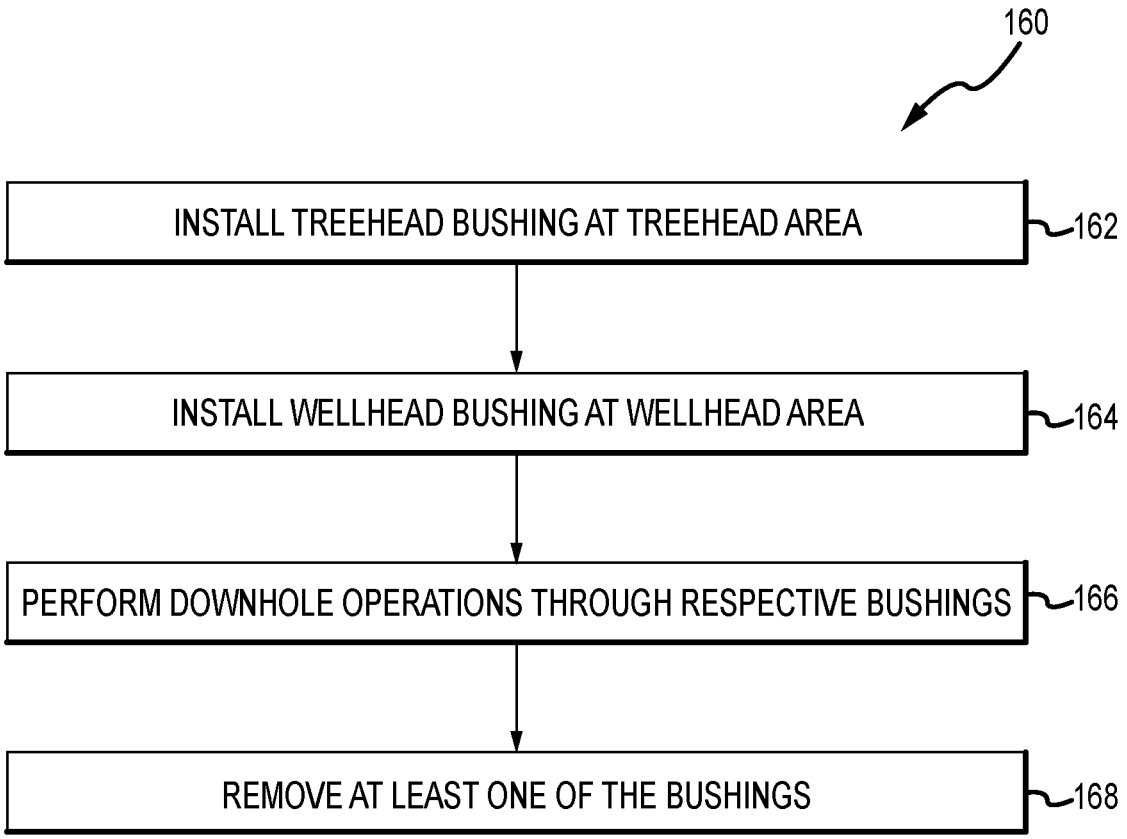
FIG. 9 is a flow chart of an embodiment of a method for installing bushings in a wellbore system, in accordance with embodiments of the present disclosure.

FIG. 9 is a flow chart illustrating a method 160 for installing a pair of bushings within a wellbore. It should be appreciated that the steps of the method may be performed in parallel or in a different order, unless explicitly stated otherwise. In various embodiments, the treehead bushing 80 is installed within the treehead area 14 (block 162). This installation may be performed prior to coupling the Christmas tree 22 to the wellbore 24 or may be performed after the Christmas tree 22 is in place. Additionally, in various embodiments, the method includes installing the wellhead bushing 50 (block 164). Similar to the treehead bushing 80, the wellhead bushing 50 may be installed before the housing is installed within the wellbore 24 or after. Furthermore, embodiments of the method include performing downhole operations through each of the bushings 50, 80 (block 166). Downhole operations may include drilling, logging, perforating, recovery, and the like. Next, at least one of the bushings 50, 80 is removed (block 168). In various embodiments, the wellhead bushing 50 is removed, for example via the installation and removal tool 116. Furthermore, in embodiments, the treehead bushing 80 is removed while the wellhead bushing 50 remains in position. Additionally, in certain embodiments, both the wellhead bushing 50 and the treehead bushing 80 may be removed. As described above, in certain embodiments the bushings 50, 80 may be removed simultaneously or nearly simultaneously. That is, the bushings 50, 80 may be removed on the same trip out of the wellbore 24. In this manner, operations within the wellbore 24 may be conducted while two bushings are present, thereby reducing the likelihood of damage to downhole components during trips into and out of the wellbore 24.

Figure 10:
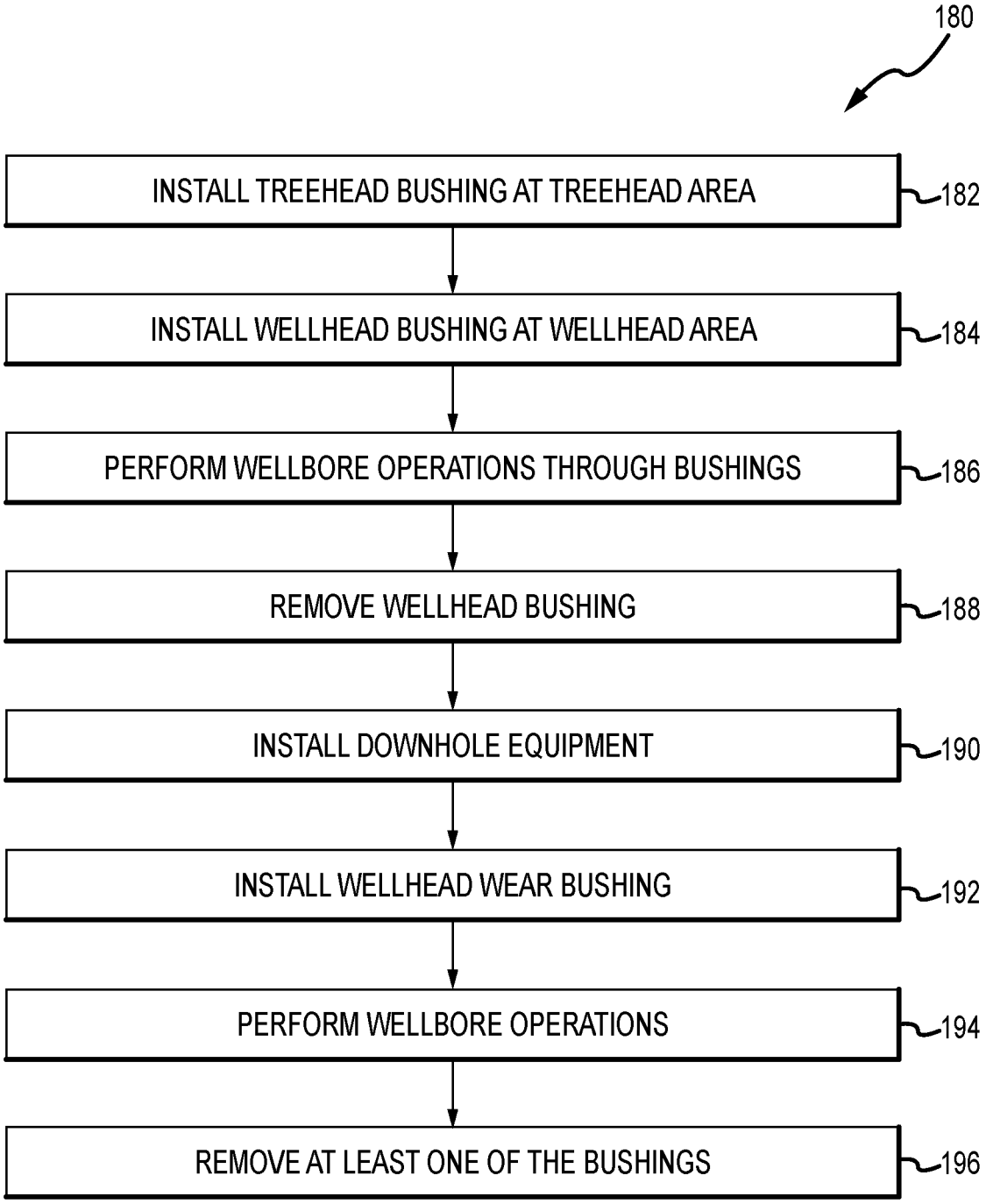
FIG. 10 is a flow chart of an embodiment of a method for installing bushings in a wellbore system, in accordance with embodiments of the present disclosure.

FIG. 10 is a flow chart of an embodiment of a method 180 for installing one or more bushings within a wellbore system 10. In various embodiments, the treehead bushing 80 is installed at the treehead area 14 (block 182) and the wellhead bushing 50 is installed at the wellhead area 12 (block 184). As described above, in various embodiments one or more of the bushings 50, 80 may be installed prior to coupling the associated equipment together. That is, the bushings 50, 80 may be installed before coupling the Christmas tree 22 and/or the high pressure housing 20 to other equipment. Wellbore operations may be performed after the bushings 50, 80 are in place (block 186). These operations may include drilling or the like, as described in detail above. Thereafter, the wellhead bushing 50 may be removed (block 188). For example, in various embodiments the wellhead bushing 50 may be removed through the treehead bushing 80 to make space for other equipment. For example, in various embodiments, the associated downhole equipment may be installed in place of the wellhead bushing 50 (block 190). In the embodiments illustrated herein, associated downhole equipment may include the casing hanger 130. Then, the wellhead wear bushing 140 may be installed (block 192). Installation may be performed through the treehead bushing 80, thereby reducing a trip into the wellbore to remove the treehead bushing 80. Thereafter, further wellbore operations may be performed (block 194). Then, at least one of the bushings 50, 140 may be removed (block 196). In certain embodiments, the bushings 50, 140 are removed simultaneously or near-simultaneously. In other embodiments, one or more installation and removal tools 116 may be staggered in a particularly arranged fashion in order to remove the bushings 50, 140 separately. In this manner, downhole operations may be conducted with a reduced risk of damaging associated equipment while also reducing a number of trips to install and/or remove the bushings.

While embodiments of the disclosure have been shown or described in only some of its forms, it should be apparent to those skilled in the art that it is not so limited, but is susceptible to various changes without departing from the scope of the disclosure.

What is claimed is:

1. A system for providing protection to one or more wellbore components, the system comprising:

a housing section positioned within a wellhead area, the housing section comprising a removable wellhead bushing arranged over at least one engagement feature of the housing section;

a Christmas tree including a treehead area, the treehead area comprising a removable treehead bushing arranged over at least one engagement feature of the treehead area; and a tubular extending through both the wellhead bushing and the treehead bushing, wherein the tubular includes an installation and removal tool adapted to remove at least one of the wellhead bushing and the treehead bushing during wellbore operations.

2. The system of claim 1, further comprising:

a wellhead wear bushing installed within the wellhead area, the wellhead wear bushing positioned to protect at least a portion of the housing section.

3. The system of claim 1, further comprising:

a protrusion formed in at least one of the wellhead bushing and the treehead bushing, the protrusion mating with a groove formed in at least one of the wellhead area and the treehead area to secure the at least one of the wellhead bushing and the treehead bushing into position.

4. The system of claim 1, further comprising:

a shoulder arranged in the wellhead area, the shoulder positioned to receive the wellhead bushing and block axial movement of the wellhead bushing in at least one direction.

5. The system of claim 1, wherein an inner diameter of the treehead bushing is greater than an outer diameter of the wellhead bushing such that the wellhead bushing may pass through the inner diameter of the treehead bushing.

6. The system of claim 1, further comprising:

a second installation and removal tool arranged on the tubular, wherein the installation and removal tool and the second installation and removal tool are configured to engage a respective treehead bushing or wellhead bushing and remove the respective treehead bushing and wellhead bushing from the wellbore at substantially the same time.

7. The system of claim 1, further comprising:

a wellhead wear bushing positioned within the wellhead area, wherein the wellhead wear bushing is installed through an inner diameter of the treehead bushing.

8. The system of claim 1, wherein the tubular is a drill string comprising a drill bit.

9. A method of installing protection component within a wellbore, the method comprising:

positioning a treehead bushing within a treehead area of a Christmas tree, the treehead bushing extending along a length of the treehead area to cover at least a portion of a surface of the treehead area;

positioning a wellhead bushing within a wellhead area of a wellbore, the Christmas tree being fluidly coupled to the wellbore, and the wellhead bushing extending along a length of the wellhead area to cover at least one surface of the wellhead area;

moving a tubular through the treehead bushing, the tubular comprising an installation and removal tool;

coupling the installation and removal tool to the wellhead bushing; and removing the wellhead bushing from the wellbore by passing the wellhead bushing through an inner diameter of the treehead bushing.

10. The method of claim 9, further comprising:

installing a downhole component within the wellbore after the wellhead bushing is removed from the wellbore, the downhole component being arranged within the wellhead area; and installing a wellhead wear bushing uphole of the downhole component, the wellhead wear bushing being installed through the inner diameter of the treehead bushing and positioned to cover at least a portion of the wellhead area and a portion of the downhole component.

11. The method of claim 10, further comprising:

coupling a second installation and removal tool to the tubular;

arranging the installation and removal tool proximate the wellhead wear bushing;

arranging the second installation and removal tool proximate the treehead bushing;

engaging both the wellhead wear bushing and treehead bushing while maintaining an axial position of the tubular; and removing both the treehead bushing and wellhead wear bushing from the wellbore.

12. The method of claim 10, further comprising:

coupling a second installation and removal tool to the tubular;

arranging the installation and removal tool proximate the wellhead wear bushing;

engaging the wellhead wear bushing via the installation and removal tool;

arranging the second installation and removal tool proximate the treehead bushing;

engaging the treehead bushing via the second installation and removal tool; and removing both the treehead bushing and wellhead wear bushing from the wellbore.

13. The method of claim 9, further comprising:

coupling a second installation and removal tool to the tubular;

arranging the installation and removal tool proximate the wellhead bushing;

arranging the second installation and removal tool proximate the treehead bushing;

engaging both the wellhead bushing and treehead bushing while maintaining an axial position of the tubular; and removing both the treehead bushing and wellhead bushing from the wellbore.

14. The method of claim 9, further comprising:

coupling a second installation and removal tool to the tubular;

arranging the installation and removal tool proximate the wellhead bushing;

engaging the wellhead bushing via the installation and removal tool;

arranging the second installation and removal tool proximate the treehead bushing;

engaging the treehead bushing via the second installation and removal tool; and removing both the treehead bushing and wellhead bushing from the wellbore.

15. The method of claim 9, further comprising:

coupling a drill bit to the tubular;

installing the drill bit into the wellbore, the drill bit passing through both the treehead bushing and the wellhead bushing; and performing drilling operations within the wellbore.

16. A method of installing protection component within a wellbore, the method comprising:

installing a treehead bushing and a wellhead bushing in a wellbore system, the treehead bushing arranged in a treehead area and the wellhead bushing arranged in a wellhead area;

positioning an installation and removal tool proximate at least one of the treehead bushing and the wellhead bushing, the installation and removal tool being part of a tubular that extends into the wellbore;

coupling the installation and removal tool to the wellhead bushing;

removing the wellhead bushing from the wellbore via the installation and removal tool through an inner diameter of the treehead bushing while the treehead bushing remains in the treehead area;

installing a downhole component through the inner diameter of the treehead bushing; and installing a wellhead wear bushing proximate the downhole component, the wellhead wear bushing covering at least a portion of a housing and at least a portion of the downhole component.

17. The method of claim 16, further comprising:

positioning the installation and removal tool proximate the treehead bushing;

coupling the installation and removal tool proximate the treehead bushing; and removing the treehead bushing from the treehead area while the wellhead wear bushing is in the wellbore.

18. The method of claim 16, further comprising:

installing a tubular through both the treehead bushing and the wellhead bushing, wherein the tubular comprises a drill string with a drill bit.

19. The method of claim 16, further comprising:

removing both the treehead bushing and the wellhead bushing from the wellbore simultaneously, wherein removing comprises changing an axial position of the treehead bushing and the wellhead bushing.

* * * * *